US010494877B2

(12) United States Patent
Barela

(10) Patent No.: US 10,494,877 B2
(45) Date of Patent: Dec. 3, 2019

(54) SUBSEA ROTATING CONTROL DEVICE APPARATUS HAVING DEBRIS BARRIER

(71) Applicant: Weatherford Technology Holdings, LLC, Houston, TX (US)

(72) Inventor: Jacob A. Barela, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/678,222

(22) Filed: Aug. 16, 2017

(65) Prior Publication Data

US 2019/0055791 A1 Feb. 21, 2019

(51) Int. Cl.

| | |
|---|---|
| ***E21B 17/01*** | (2006.01) |
| ***E21B 23/03*** | (2006.01) |
| ***E21B 23/08*** | (2006.01) |
| ***E21B 17/00*** | (2006.01) |
| ***E21B 33/08*** | (2006.01) |
| ***E21B 23/02*** | (2006.01) |
| ***E21B 33/064*** | (2006.01) |

(52) U.S. Cl.

CPC ..... *E21B 17/006* (2013.01); *E21B 17/01* (2013.01); *E21B 23/02* (2013.01); *E21B 23/03* (2013.01); *E21B 23/08* (2013.01); *E21B 33/064* (2013.01); *E21B 33/085* (2013.01)

(58) Field of Classification Search

None

See application file for complete search history.

(56) References Cited

U.S. PATENT DOCUMENTS

| | | | | |
|---|---|---|---|---|
| 1,005,943 | A * | 10/1911 | De Vilbiss, Jr. ..... | G01G 1/00 177/167 |
| 7,926,593 | B2 | 4/2011 | Bailey et al. | |
| 8,322,432 | B2 | 12/2012 | Bailey et al. | |
| 8,347,983 | B2 | 1/2013 | Hoyer et al. | |

(Continued)

FOREIGN PATENT DOCUMENTS

WO 2012140446 A2 10/2012

OTHER PUBLICATIONS

GB Search Report based on copending GB Application No. 1812083.2, dated Dec. 5, 2018, 5 pages.

(Continued)

*Primary Examiner* — Matthew R Buck
*Assistant Examiner* — Douglas S Wood
(74) *Attorney, Agent, or Firm* — Blank Rome, LLP

(57) ABSTRACT

A riser apparatus includes a riser section and a flow control device. The riser section is disposed on a riser. The flow control device's body installs in the riser section. The assembly may install between uphole and downhole side ports, which may be interconnected by bypass piping and an intermediate device, such as a pump. At least one annular seal rotatably supported by bearings in the body's inner bore can engage a tubular passing therethrough and can seal an annulus therebetween. In one example, pressure uphole of the annular seal may be kept greater than downhole pressure. A debris barrier disposed on the uphole end of the body covers an annular area from an outer perimeter at the exterior of the body toward a central opening at the inner bore. The debris barrier prevents debris, such as drilling cuttings, uphole of the debris barrier from entering into the body's inner bore.

31 Claims, 5 Drawing Sheets

(56) References Cited

U.S. PATENT DOCUMENTS

| | | | | |
|---|---|---|---|---|
| 8,770,297 | B2 | 7/2014 | Bailey et al. | |
| 9,856,713 | B2 * | 1/2018 | Tarique | E21B 33/085 |
| 10,053,943 | B2 * | 8/2018 | Hannegan | E21B 33/085 |
| 2008/0296016 | A1 | 12/2008 | Hughes et al. | |
| 2009/0200747 | A1 * | 8/2009 | Williams | E21B 33/085 277/344 |
| 2014/0196954 | A1 | 7/2014 | Mahmood et al. | |
| 2015/0233212 | A1 | 8/2015 | Leggett | |
| 2015/0315874 | A1 | 11/2015 | Chambers | |
| 2016/0273297 | A1 | 9/2016 | Hannegan et al. | |

OTHER PUBLICATIONS

First Office Action received in copending CA Application No. 3012661, dated May 8, 2019, 6 pages.

* cited by examiner

SUBSEA ROTATING CONTROL DEVICE APPARATUS HAVING DEBRIS BARRIER

BACKGROUND OF THE DISCLOSURE

A rotating control device is typically used to seal off an annular space between an outer tubular structure (such as, a riser, a housing on a subsea structure in a riser-less system, or a housing attached to a surface wellhead) and an inner tubular (such as, a drillstring). Because components of the rotating control device, such as bearings, seals, etc., may need to be replaced or repaired, it is useful to use a retrievable rotating control device that can be installed in (and retrieved from) a riser or the like. However, debris created during operations, such as drilling, can hinder the installation and retrieval of such a retrievable rotating control device into and out of the riser. Also, proper functioning of the retrievable rotating control device during operations can be hindered by debris from the operations.

The subject matter of the present disclosure is directed to overcoming, or at least reducing the effects of, one or more of the problems set forth above.

SUMMARY OF THE DISCLOSURE

According to the present disclosure, an apparatus is used for a riser having an internal passage through which a tubular passes. In one embodiment, the apparatus includes at least one annular seal and a debris barriers. The at least one annular seal is rotatably supported by at least one bearing in the internal passage of the riser. The at least one annular seal engages the tubular passing therethrough and seals an annulus between the tubular and the internal passage of the riser. The debris barrier is disposed uphole of the at least one annular seal. The debris barrier covers an annular area from an outer perimeter at the internal passage of the riser toward a central opening, and the debris barrier inhibits debris uphole of the debris barrier from entering into the inner bore.

In another embodiment, the apparatus includes a body, at least one annular seal, and a debris barrier. The body installs in the riser and defines a bore therethrough from an uphole end to a downhole end. The at least one annular seal rotatably is supported by at least one bearing in the bore of the body. The at least one annular seal engages the tubular passing therethrough and seals an annulus between the tubular and the bore of the body. The debris barrier is disposed on the uphole end of the body and extends from an outer perimeter toward the bore of the body. The debris barrier inhibits debris uphole of the debris barrier from entering into the bore.

In yet another embodiment, the apparatus includes a riser section, a body, at least one annular seal, and a debris barrier. The riser section is disposed on the riser and has a main bore therethrough, the main bore communicating with the internal passage. The body installs in the main bore of the riser section and defines an inner bore therethrough from an uphole end to a downhole end. The at least one annular seal is rotatably supported by at least one bearing in the inner bore of the body. The at least one annular seal engages the tubular passing therethrough and seals an annulus between the tubular and the inner bore of the body. The debris barrier is disposed on the uphole end of the body and extends from an outer perimeter toward the bore of the body. The debris barrier inhibits debris uphole of the debris barrier from entering into the bore.

The body installing in the riser can have a latch disposed thereon that is activatable to engage a profile in the internal passage of the riser. For example, the main bore of the riser section can define a profile therein, and the body can have a latch disposed on the body that is activatable to engage the profile.

The at least one annular seal can support a pressure differential thereacross in the annulus in which an uphole pressure is greater than a downhole pressure or in which a downhole pressure is greater than an uphole pressure. In one example, the at least one annular seal can include at least first and second seals stacked one above the other in the bore of the body and configured to support a greater uphole pressure than a downhole pressure.

The body installing in the riser can have at least one external seal disposed on an exterior of the body to sealably engage the internal passage of the riser. For example, the at least one external seal can be at least one of a swab seal, a cup seal, a chevron seal, and a compressible packer element disposed on the exterior at the uphole end of the body.

For assembly/disassembly at surface, the debris barrier can define at least one division permitting lateral placement of the debris barrier around a central tool (e.g., running/retrieval tool) extending from the bore at the uphole end of the body. For example, the debris barrier can include at least two segments separately affixable to the uphole end of the body.

The debris barrier can cover an annular area from the outer perimeter at an exterior surface of the body toward a central opening at the bore. For example, the debris barrier can include a cylindrical sidewall and a frusto-conical sidewall. The cylindrical sidewall on the outer perimeter can extend uphole from the uphole end of the body, and the frusto-conical sidewall can covering the annular area extending from the cylindrical sidewall centrally inward toward the central opening.

For its part, the riser section can define an uphole side port communicating with the main bore, and the debris barrier disposed on the uphole end of the body can position downhole of the uphole side port in the riser section. The riser section may also defines a downhole side port communicating with the main bore, and bypass piping can interconnect the downhole side port with the uphole side port. An intermediate flow device can disposed on the bypass piping and can be in fluid communication between the uphole and downhole side ports. The intermediate flow device can include at least one of a pump, a valve, a choke, a sensor, and a flowmeter.

According to the present disclosure, a method can be used to seal against a tubular passing through an internal passage of a riser. A debris barrier and at least one annular seal install in the internal passage of the riser. The tubular passes through the debris barrier uphole of the at least one annular seal in the internal passage of the riser, and an annulus between the tubular and the internal passage is sealed with the at least one annular seal rotatably supported by at least one bearing in the internal passage. Debris uphole of the debris barrier is inhibited from passing to the at least one annular seal.

To install the debris barrier and the at least one annular seal in the internal passage of the riser, a running tool can be inserted into an inner bore of a body at surface, and the debris barrier can affix on an uphole end of the body about the inserted running tool. The body can be set in the internal passage with the running tool, which can be removed from the set body.

To affix the debris barrier on the uphole end of the body about the inserted running tool, at least one division of the debris barrier can be separated, the debris barrier can be laterally placed around inserted running tool, and the debris barrier can affix to the uphole end of the body. Alternatively, the debris barrier can be run longitudinally along the inserted running tool and affixed to the uphole end of the body.

To install the debris barrier and the at least one annular seal in the internal passage of the riser, a latch on a body supporting the debris barrier and the at least one annular seal can engage in a profile defined in the internal passage. Also, at least one external seal disposed on such a body can engage against the internal passage.

The foregoing summary is not intended to summarize each potential embodiment or every aspect of the present disclosure.

DETAILED DESCRIPTION OF THE DISCLOSURE

Figure 1A:
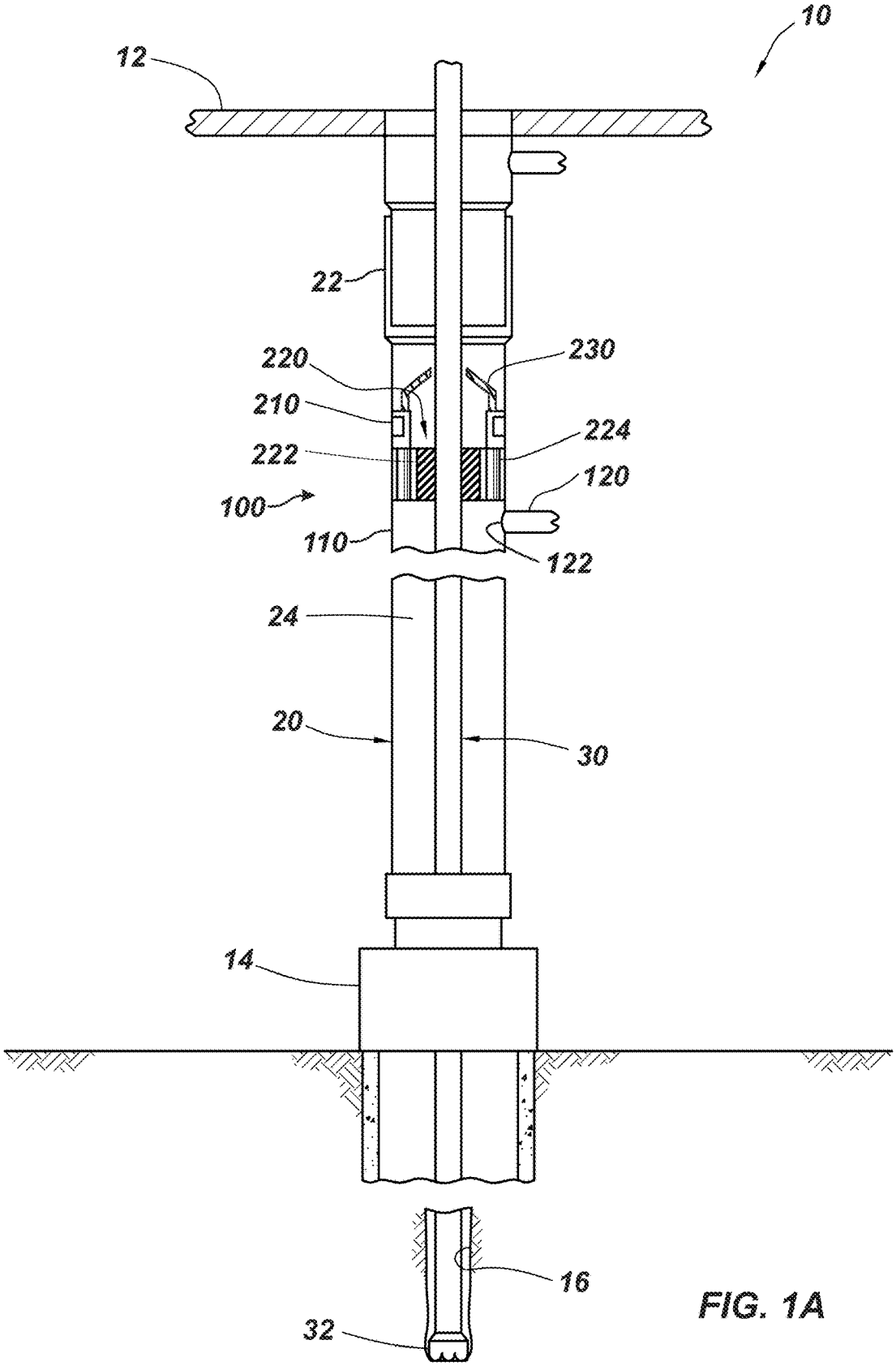
FIGS. 1A-1B illustrate well systems according to the present disclosure.
Figure 1B:
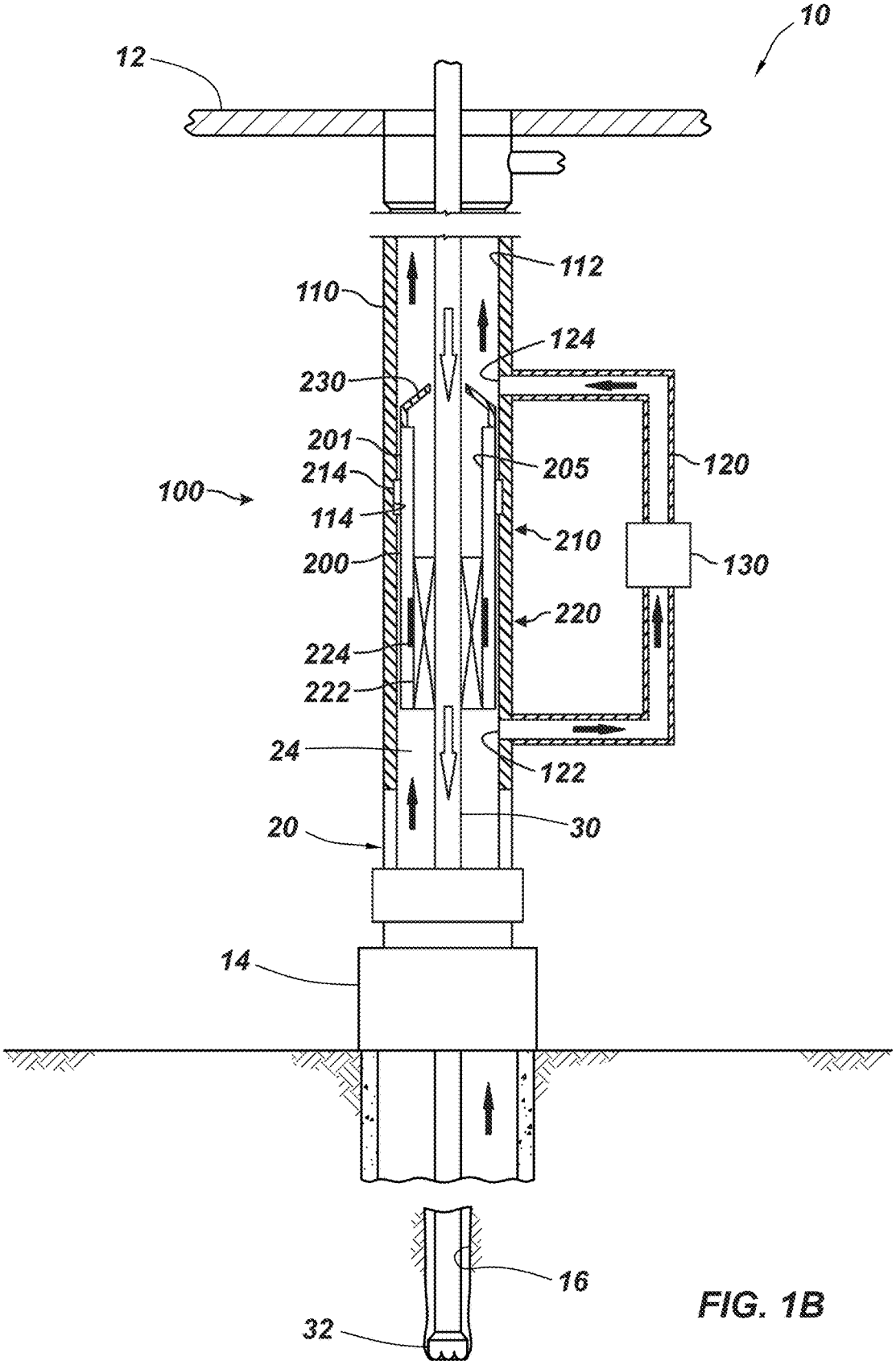

A well system 10 illustrated in FIGS. 1A-1B includes a riser 20 extending from an offshore rig 12 to a subsea wellhead installation 14, which can include, for example, various blowout preventers, hangers, fluid connections, etc. During operations, a drillstring 30 may extend through the riser 20, and a drill bit 32 on the drillstring 30 may be rotated for drilling a wellbore 16 into a formation. In general, the drill bit 32 can be rotated by rotating the drillstring 30 (for example, using a top drive or rotary table of the rig 12), and/or a drilling motor may be connected in the tubular string above the drill bit 32.

During the drilling operation or other rig operations, returns (drilling fluid, cuttings, formation fluids, and the like) return up the annulus 24 between the riser 20 and the drillstring 30. In a typical drilling operation, for example, drilling fluid can be circulated from the rig 12 downward through the drillstring 30, outward from the drill bit 32, and then upward through the annulus 24.

A number of fluid handling arrangements can be used on the riser 20 to handle the returns for various purposes, such as for managing pressure, controlling influxes from the formation, etc. In the current system 10 of FIGS. 1A-1B, a marine riser apparatus 100 is positioned on the riser 20 between the rig 12 and the installation 14 to handle the returns. The riser apparatus 100 includes a riser section 110 connected to the riser 20 and includes a flow control device 200 disposed in the riser section. The flow control device 200 can be disposed either below a tensioner ring 22, above the tensioner ring 22, or elsewhere.

In the arrangement of FIG. 1A, the riser section 110 includes a side port 122 that allows the annulus 24 to communicate with a conduit 120, which can in turn communicate with other fluid handling equipment, such as drilling chokes, pumps, and the like, that may be disposed on the rig 12 or elsewhere. The flow control device 200 installed in the riser section 110 can contain the returns for passage to this conduit 120 and the fluid handling equipment.

The flow control device 200 includes a seal assembly 220, which includes one or more rotating control devices (RCDs). In particular, the assembly 220 has at least one annular seal 222 that is configured to sealingly engage an exterior of the drillstring 30 and seal off the annulus 24 above the side port 122. The annular seal 222 may be of a type known to those skilled in the art as "passive," "active" or a combination of passive and active. Because the at least one annular seal 222 engages the drillstring 30, which can rotate, at least one bearing 224 of the seal assembly 220 allows the at least one annular seal 222 to rotate relative to the riser section 110. The bearing 224 can be self-lubricated, providing lubrication to the internal bearings and the annular seals so that they may rotate with the drillstring 30 and not seize up from overheating during the drilling process.

In one embodiment, the seal assembly 220 can be integrated into, or part of, the riser section 110. Preferably, however, the flow control device 200 includes a latch assembly 210 that allows the flow control device 200 to be releasably secured in the riser section 110 to support the seal assembly 220 upstream from the side port 122. As shown in FIG. 1A, for example, the flow control device 200 has been conveyed into the riser section 110 for the latch assembly 210 to cooperatively engage an internal profile of the riser section 110. Thus, further downward displacement of the flow control device 200 relative to the riser section 110 is prevented. In this way, the latch assembly 210 permits the annular seal 222 and/or the bearing 224 to be installed in (and/or retrieved from) the riser section 110 when desired, for example, to service or replace the seal 222 and/or bearing 224. Running and retrieval tools (not shown) deployed on tubulars from the rig 12 can be used for installing and retrieving the flow control device 200 in the riser section 110.

During rig operations, the at least one annular seal 222 supports a pressure differential thereacross in the annulus 24. Depending on the implementation, the pressure uphole of the at least one annular seal 222 may be greater than the pressure downhole, or the pressure downhole of the at least one annular seal 222 may be greater than the pressure uphole. In a typical implementation such as shown in FIG. 1A, the downhole pressure of the annulus 24 below the flow control device 200 is greater than the uphole pressure of the annulus 24, but other implementations are possible.

During rig operations, various forms of debris (e.g., cuttings, foreign materials, dropped components, and the like) may potentially enter the riser 20 uphole of the flow control device 200. Such debris can cause a number of problems, such as lodging inside the at least one annular seal 222 and bearing 224, damaging their components, lodging between the latch assembly 210 and riser section 110, hindering retrieval of the drillstring 30, hindering retrieval of the flow control device 200, etc. To protect the flow control device 200 (and especially the seal assembly 220), a debris barrier 230 is disposed toward an uphole end and acts as a barrier to inhibit or prevent debris from entering the device 200, seal assembly 220, latch area, etc.

In the embodiment where the seal assembly 220 is integrated into, or part of, the riser section 110, the debris barrier 230 can likewise be integrated into, or part of, the riser section 110. Preferably, however, the debris barrier 230 is disposed on the latch assembly 210 that allows the flow control device 200 to be installed into, and retrieved from, the riser section 110.

The debris barrier 230 can be composed of an elastomeric material similar to that used for the annular seal 222. Other materials could be used that are resilient enough to hold shape and prevent collected debris from passing into the flow control device 200, but flexible enough to allow for passage of tubulars, connections, tools, joints, and the like therethrough. In general, the debris barrier 230 may not form a fluid seal with the drillstring 30 or other tool when disposed therein. However, the debris barrier 230 and/or some other external sealing element can seal portion of the flow control device 200 inside the riser section 110.

As shown in another arrangement of FIG. 1B, the riser section 110 disposed on the riser 20 has a main bore 112 therethrough, which communicates with the internal passage of the riser 20. A downhole side port 122 and an uphole side port 124 communicate with the main bore 112, and bypass piping 120 interconnects the side ports 122, 124 with one another. An intermediate device 130 can be disposed on the bypass piping 120 in fluid communication between the side ports 122, 124. Such an intermediate device 130 can include one or more pumps, valves, flowmeters, sensors, chokes, or other flow components to provide a number of operational functions. As an example disclosed in US 2013/0192841, a flowmeter and a choke can be used on a bypass around a rotating flow control device on a riser. As another example disclosed in WO 2017/003406, a pump can be used on a bypass around a rotating flow control device on a riser.

As shown in FIG. 1B, the flow control device 200 installed in the riser 20 adjacent to the bypass piping 120 has a body or housing 201 that installs in the main bore 112 of the riser section 110 in between the side ports 122, 124. The housing 201 defines an inner bore 205 therethrough from an uphole end to a downhole end and includes a latch assembly 210 coupled to a seal assembly 220.

The main bore 112 of the riser section 110 defines a latch profile 114, and the latch assembly 210 disposed on the device 200 has a latch 214 activatable to engage the latch profile 114. Additionally, the seal assembly 220 includes at least one annular seal 222 rotatably supported by at least one bearing 224 in the inner bore 205. The at least one annular seal 222 engages the drillstring 30 or other tubular passing therethrough and seals the annulus 24 between the drillstring 30 and the inner bore 205 of the device 200.

The flow control device 200 provides a physical barrier between the wellbore fluids located above and below it in the riser 20. This fluid isolation can be used for various reasons, such as for managed pressure drilling or the like. The fluid isolation may also be necessitated by use of the bypass piping 120 and the intermediate device 130. Therefore, depending on the implementation, an uphole pressure in the annulus 24 above the flow control device 200 may be greater than a downhole pressure, or the downhole pressure may be greater than the uphole pressure. In one particular implementation, the intermediate device 130 may include a pump on the bypass piping 120, the pump's suction pressure may purposely create a pressure differential across the at least one annular seal 222 such that pressure above the seal 222 is higher than below. Therefore, the pressure of the annulus 24 uphole the flow control device 200 may be greater than the downhole pressure of the annulus 24.

During operation, the returns having drilling fluid, formation fluids, cuttings, and the like are diverted by the bypass piping 120 around the flow control device 200 and pumped out of the uphole side port 124. Debris (especially drilling cuttings) in the returns exiting the uphole side port 124 may therefore tend to collect uphole of the flow control device 200. Accordingly, the debris barrier 230 covers an annular area from an outer perimeter at the exterior surface of the assembly's body 201 toward a central opening at the inner bore 205 and can prevent cuttings and other debris settling on the top side of the flow control device 200 from entering into the flow control device 200.

Figure 2:
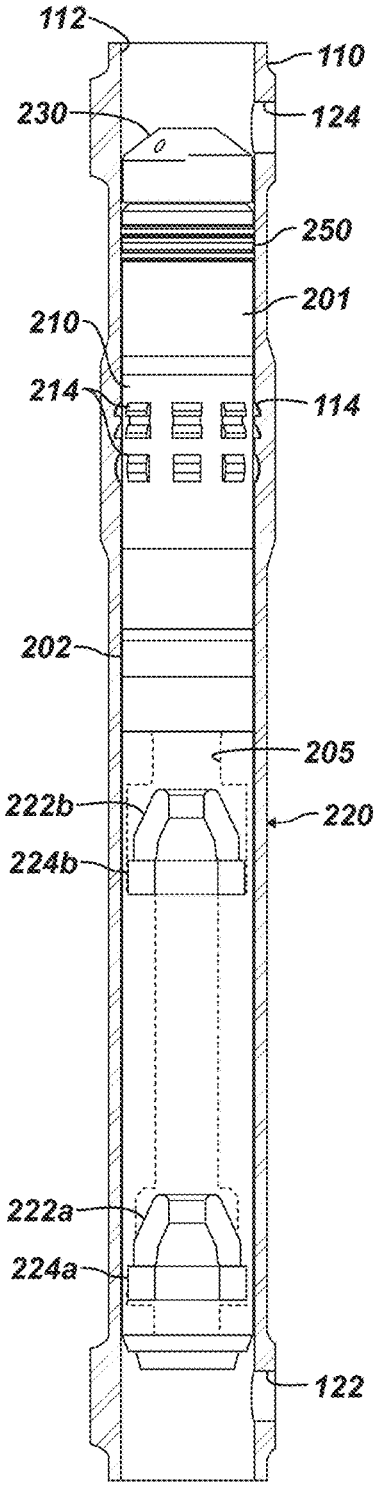
FIG. 2 illustrates a riser apparatus according to one embodiment of the present disclosure having a flow control device with a latch assembly supporting a seal assembly in a riser section.

Having an understanding of how the disclosed riser apparatus 100 can be used in well systems 10, FIG. 2 illustrates additional details of a riser apparatus 100 according to one embodiment of the present disclosure having a flow control device 200 with a latch assembly 210 supporting a seal assembly 220 in a riser section 110.

The riser section 110 is a tubular component for connecting along a riser of a well system using conventional connections (not shown). Downhole and uphole side ports 122, 124 communicate the main bore 112 out of the riser section 110 for connecting to communication lines, bypass piping, or the like, as described previously. A latch profile 114 is defined in the main bore 112 between the side ports 122, 124.

The flow control device 200 includes a housing or body 201 that installs inside the section's main bore 112, and latch members 214 of the latch assembly 210 are activatable to latch in the latch profile 114. The seal assembly 220 includes dual rotating control seals 222*a-b* with bearings 224*a-b* stacked one above the other in the inner bore 205 of the flow control device 200. As shown here, the dual rotating control seals 222*a-b* can be arranged to hold higher pressure uphole of the seals 222*a-b*, such as in the implementation of FIG. 1B. An opposite arrangement could also be used.

At least one external seal 202, 250 is disposed on the exterior of the body 201 and sealably engages the main bore 112 of the riser section 110. The at least one external seal 202 can include a packer element being compressible on the exterior of the body 201. Additionally, the at least one external seal 250 can include a swab seal, cup seal, chevron seal, or the like disposed circumferentially at the uphole end of the body 201. Finally, the uphole end of the body 201 includes the debris barrier 230.

Figure 3A:
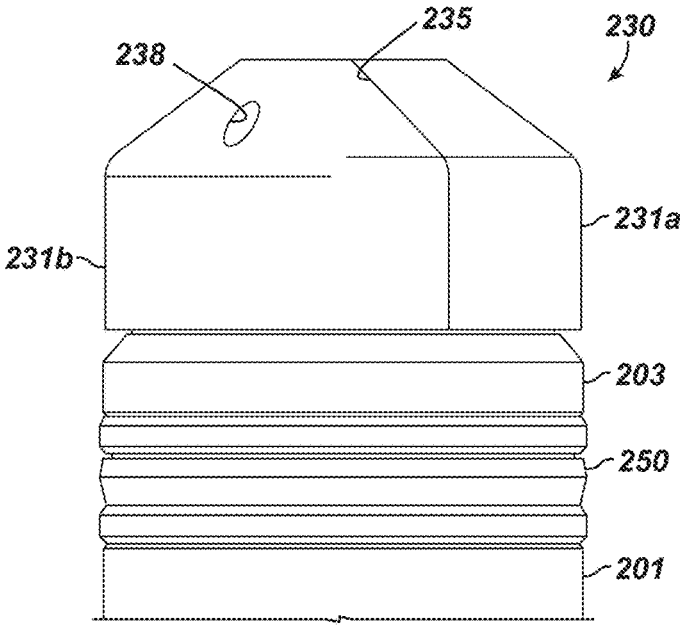
FIG. 3A illustrates an elevational view of a debris barrier on an uphole end of the latch assembly.
Figure 3B:
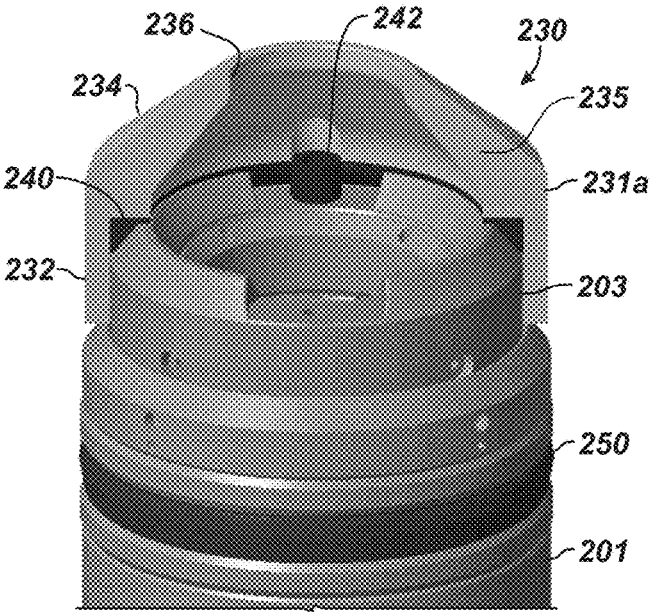
FIG. 3B illustrates a perspective view of portion of the debris barrier on the uphole end of the latch assembly.

FIG. 3A illustrates an elevational view of the debris barrier 230 on the uphole end of the of the flow control device's body 201, and FIG. 3B illustrates a perspective view of portion of the debris barrier 230 on the uphole end. The debris barrier 230 can define at least one division 235 permitting lateral placement of the debris barrier 230 around a running or other tool (not shown) when the tool extends from the bore at uphole end of the body 201.

The division 235 can separate the debris barrier 230 into at least two segments 231*a-b* that are separately affixable to the uphole end 203 of the body 201. For example, the segments 231*a-b* can be separate halves that bolt through exposed holes 238 to bolt openings 242 in the uphole end 203 of the body 201. The uphole end 203 typically has such bolt openings 242 used for lifting purposes, and these can also be used for affixing the debris barrier 230. In this way, the separate segments 231*a-b* can position laterally around a running/retrieval tool (not shown) at the rig when the tool extends from the bore at uphole end of the body 201. Alternatively, the division 235 can be a single split in one side of the circumferential debris barrier 230 that would allow the split barrier 230 to flex open and position laterally around a running/retrieval tool (not shown) at the rig when the tool extends from the bore at uphole end of the body 201.

As noted previously, the debris barrier 230 covers an annular area from an outer perimeter at the exterior surface of the body 201 toward a central opening at the bore 205. As shown in particular in FIG. 3B, the debris barrier 230 includes a cylindrical sidewall 232 and a frusto-conical sidewall 234 supported on a support ring 240. The cylindrical sidewall 232 is disposed on the outer perimeter and extends upward from the uphole end 203 of the body 201. The cylindrical sidewall 232 can provide an annular seal on the uphole end 203, which may supplement the external seal 250. For its part, the frusto-conical sidewall 234 covers the annular area extending from the cylindrical sidewall 232 centrally inward toward a central opening 236.

Figure 4A:
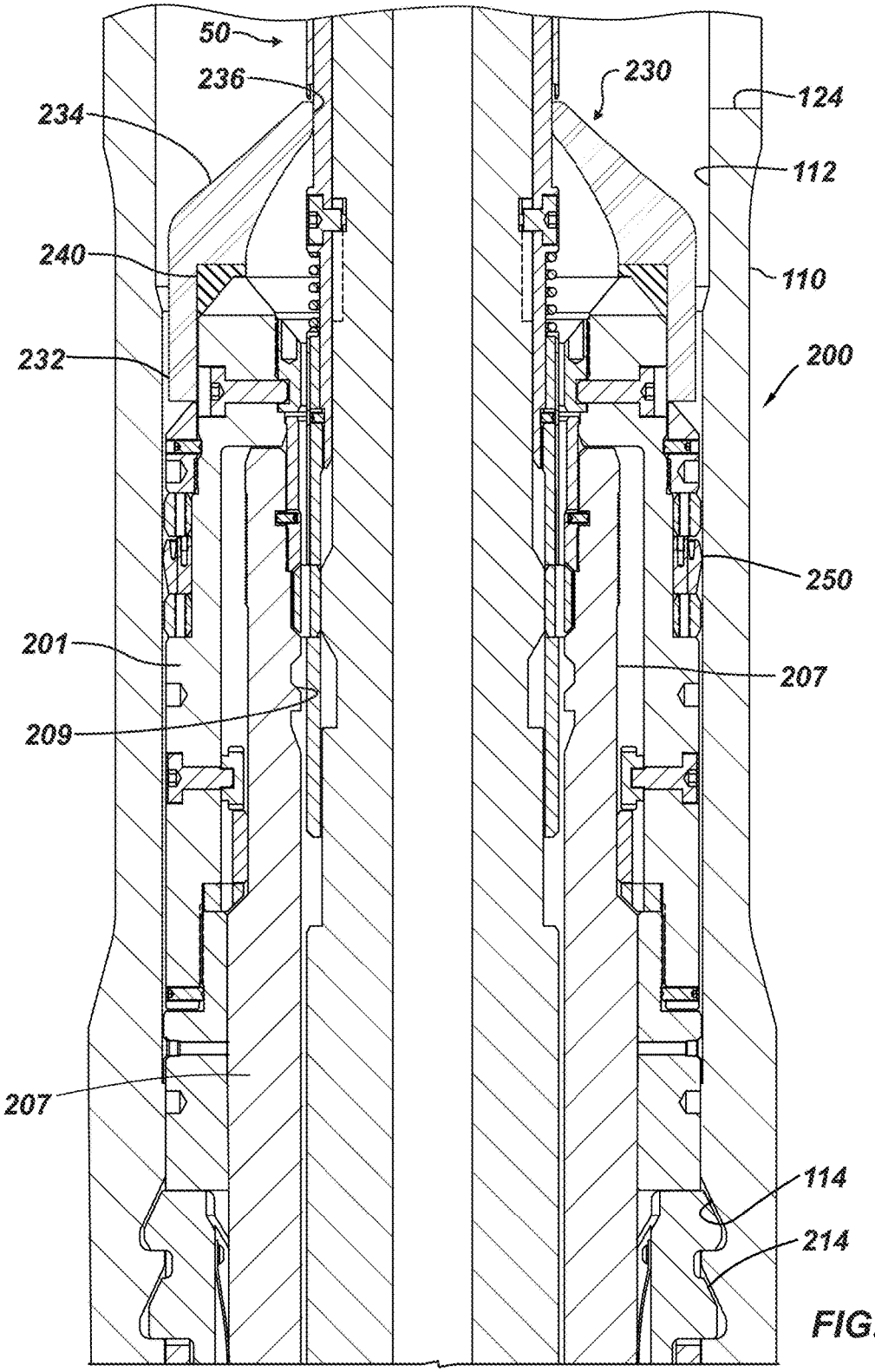
FIG. 4A illustrates a portion of a running tool installing the latch assembly for the flow control device in the riser section.

As noted above, tool(s) can be used for installing/retrieving the flow control device 200 from the riser section 110. Turning now to FIG. 4A, a portion of a tool 50 is shown installed in the flow control device 200 in the riser section 110. This tool 50 is a running tool used for installing the device 200 in the riser section 100. A corollary retrieval tool (not shown) can be used for retrieving the device 200 from the riser section 110. Further details are disclosed in copending U.S. application Ser. No. 15/153,356, filed 12 May 2016, which is incorporated herein by reference in its entirety.

During assembly at the rig (12), the running tool 50 is preferably installed and fitted in the latch assembly 210 before the debris barrier 230 is installed on the top of the latch assembly 210. Likewise, during disassembly at the rig (12), the debris barrier 230 may preferably be removed from the latch assembly 210 while the pulling tool remains installed in the assembly 210.

To achieve this, for example and as noted above with reference to FIG. 3B, the debris barrier 230 can include two or more separate segments 231*a-b* that fit together onto the top of the latch assembly 210. This can facilitate assembly/disassembly of the debris barrier 230 over the running tool 50 (and pulling tool as well as), while installed in the flow control device 200. As also noted, the debris barrier 230 with a single split may also be used to fit laterally onto/off of the top of the latch assembly 210 while the running/pulling tool 50 remains installed therein. Likewise, depending on assembly steps possible at the rig (12), it may be possible for a fully-cylindrical barrier 230 to slide along the installed tool 50 to affix/detach the barrier 230 on the top of the latch assembly 210 while the running/pulling tool 50 remains installed therein.

As noted previously, the flow control device 200 includes the latch assembly 210 and the seal assembly, which is not shown in FIG. 4A. The latch assembly 210 locates and locks the flow control device 200 in the riser section 110 and provides the annular seal 250 against the main bore 112 of the riser section 210. Profiles 209 on the inside of a mandrel 207 of the latch assembly 210 cooperate with the running tool 50 (and retrieval tool) used in setting (and retrieving) the device 200. Once the running tool 50 is installed into the latch assembly 210, the flow control device 200 can be picked up and run in the riser to the riser section 110. Each external lock dog 214 has a bow spring that allows the external lock dog 214 to be able to collapse and expand to ride the inner diameter of the riser (20) until the dog 214 is able to locate a matching selective profile 114 machined in the riser section 110.

When the debris barrier 230 is in place in the riser section 110, the cylindrical sidewall 232 forms a partial annular seal with the main bore 112 of the riser section 110 and can supplement the external seal 250 engaging the main bore 112. The frusto-conical sidewall 235 supported by the support ring 240 can be flared open at the opening 236 to accommodate the running tool 50, which is operable to shift the inner mandrel 207 inside the body 201 and engage the latch members 214 in the profiles 114.

To set the latch assembly 210, the inner mandrel 207 is first released. To do this, the external lock dogs 214 become fully extended into the profiles 114, and a set down force is applied on the mandrel 207, which releases a mandrel collet. The setting force shifts the mandrel 207 down. As the mandrel 207 shifts down, the external lock dogs 214 are forced out into the profile 114, and the packer element (202) on the device 200 is compressed to seal within the riser section 110. Finally, a ratchet sleeve is engaged to lock the mandrel 207 in a set position.

Figure 4B:
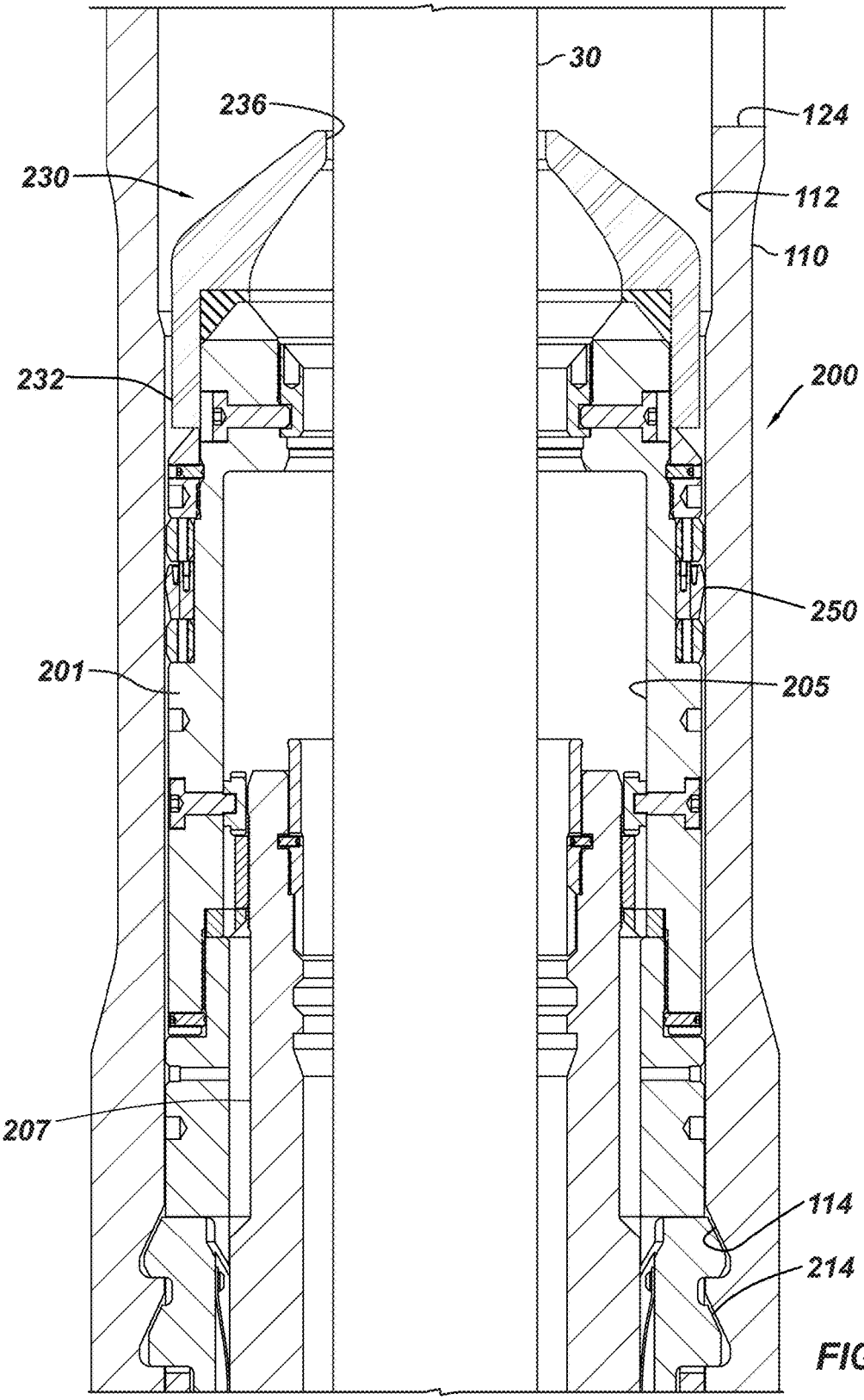
FIG. 4B illustrates a portion of the latch assembly for the flow control device in the riser section having a drillstring passing therethrough.

Once the latch assembly 210 is set in the riser section 100 and the running tool 50 is removed, a drillstring 30 and other tools can be run through the flow control device 200. For example, FIG. 4B illustrates a portion of the flow control device 200 having the inner mandrel 207 shifted to engage the latch members 214 in the profile 114 of the riser section 110. A drillstring 30 extends through the assembly's bore 205 and passes through the debris barrier's opening 236.

As shown, the external seal 250 provides a barrier for the exterior of the device 200 to prevent debris from entering into the external lock dog area. The cylindrical sidewall 232 of the debris barrier 230 may also help to seal off the external lock dog area. As noted, the debris barrier 230 preferably does not make a seal with the drillstring 30 and is not configured to rotate even though the drillstring 30 passes therethrough and may rotate during drilling operations. The debris barrier 230 preferably does not produce a pressure seal because a rapid increase in a pressure differential external of the device 200 can rupture/blow out the device's seal(s) (222). Instead, the debris barrier 230 prevents debris uphole in the riser section 110 and upper riser (20) from entering into the bore 205 of the assembly's body 201.

As shown, the opening 236 of the debris barrier 230 may be slightly larger than the outside diameter of the drillpipe 30 to prevent sealing and is able to expand over the tool joints and the like as they pass through. The debris barrier 230 may not be configured to rotate on the top of the latch assembly 210 so bearings and the like are not used. Instead, the debris barrier 230 may remain statically positioned on the latch assembly 210 while maintaining a barrier around the drillstring 30.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of sealing against a tubular passing through an internal passage of a riser, the method comprising:

inserting a running tool into an inner bore of a body at surface, the body having at least one annular seal in the inner bore;

affixing a debris barrier on an uphole end of the body about the inserted running tool, the debris barrier having a sidewall and a cover, the sidewall disposed about an external surface of the body, the cover extending from the sidewall to a central opening defined in the cover, the cover covering an annular area from a perimeter of the bore of the body toward a center of the bore;

installing the body having the debris barrier and the at least one annular seal in the internal passage of the riser using the running tool;

removing the running tool from the set body;

passing the tubular through the debris barrier uphole of the at least one annular seal in the internal passage of the riser;

sealing an annulus between the tubular and the inner bore of the set body with the at least one annular seal in the internal passage; and inhibiting debris uphole of the debris barrier from passing to the at least one annular seal.

2. The method of claim 1, wherein affixing the debris barrier on the uphole end of the body about the inserted running tool comprises: separating at least one division of the debris barrier; laterally placing the debris barrier around the inserted running tool; and affixing the debris barrier to the uphole end of the body.

3. The method of claim 1, wherein affixing the debris barrier on the top end of the body about the inserted running tool comprises longitudinally running the debris barrier along the inserted running tool; and affixing the debris barrier to the uphole end of the body.

4. The method of claim 1, wherein installing the body in the internal passage of the riser comprises engaging a latch on the body in a profile defined in the internal passage.

5. The method of claim 1, wherein installing the body in the internal passage of the riser comprises engaging at least one external seal disposed on the body against the internal passage.

6. The method of claim 1, wherein the sidewall of the debris barrier comprises a cylindrical sidewall on the outer perimeter extending uphole from the uphole end of the body; and wherein the cover comprises a frusto-conical sidewall covering the annular area extending from the cylindrical sidewall centrally inward toward the central opening.

7. The method of claim 2, wherein the at least one division of the debris barrier comprises at least two segments; and wherein separating the at least one division of the debris barrier; laterally placing the debris barrier around the inserted running tool; and affixing the debris barrier to the uphole end of the body comprises separately affixing the at least two segments of the debris barrier to the uphole end of the body.

8. An apparatus for a riser, the riser having an internal passage through which a tubular passes, the apparatus comprising:

a body installing in the internal passage of the riser and defining a bore therethrough from an uphole end to a downhole end, the body having an external surface disposed about the uphole end;

at least one annular seal supported in the bore of the body, the at least one annular seal engaging the tubular passing therethrough and sealing an annulus between the tubular and the bore of the body; and a debris barrier disposed on the uphole end of the body, the debris barrier having a sidewall and a cover, the sidewall disposed about the external surface of the body, the cover extending from the sidewall to a central opening defined in the cover, the cover covering an annular area from a perimeter of the bore of the body toward a center of the bore, the debris barrier inhibiting debris uphole of the debris barrier from entering into the bore.

9. The apparatus of claim 8, wherein the sidewall comprises a cylindrical sidewall disposed on the exterior surface and extending uphole from the uphole end of the body; and wherein the cover comprises a frusto-conical sidewall covering the annular area extending from the cylindrical sidewall centrally inward toward the central opening.

10. The apparatus of claim 8, wherein the at least one annular seal is rotatably supported by at least one bearing in the bore of the body.

11. The apparatus of claim 8, the apparatus installing in the internal passage of the riser using a removable running tool, wherein the debris barrier defines at least one division extending along the sidewall and the cover, the at least one divisional permitting lateral placement of the debris barrier around the removable running tool extending from the bore at the uphole end of the body.

12. The apparatus of claim 8, wherein the body comprises a latch disposed on the body and activatable to engage a profile in the internal passage of the riser.

13. The apparatus of claim 11, wherein the debris barrier defining the at least one division comprises at least two segments separately affixable to the uphole end of the body.

14. The apparatus of claim 8, the apparatus comprising:

a riser section disposed on the riser and having a main bore therethrough, the main bore communicating with the internal passage; wherein the body installs in the main bore of the riser section.

15. The apparatus of claim 14, wherein the at least one annular seal supports a pressure differential thereacross in the annulus in which an uphole pressure is greater than a downhole pressure.

16. The apparatus of claim 14, wherein the at least one annular seal supports a pressure differential thereacross in the annulus in which a downhole pressure is greater than an uphole pressure.

17. The apparatus of claim 14, wherein the at least one annular seal comprises at least first and second seals stacked one above the other in the bore of the body.

18. The apparatus of claim 14, further comprising at least one external seal disposed on an exterior of the body and sealably engaging the main bore of the riser section.

19. The apparatus of claim 14, wherein the main bore of the riser section defines a profile therein; and wherein the body comprises a latch disposed on the body and being activatable to engage the profile.

20. The apparatus of claim 14, wherein the riser section defines an uphole side port communicating with the main bore; and wherein the debris barrier disposed on the uphole end of the body positions downhole of the uphole side port in the riser section.

21. The apparatus of claim 20, wherein the riser section defines a downhole side port communicating with the main bore and disposed downhole of the body.

22. The apparatus of claim 21, further comprising bypass piping interconnecting the downhole side port with the uphole side port.

23. The apparatus of claim 22, further comprising an intermediate flow device disposed on the bypass piping and being in fluid communication between the uphole and downhole side ports.

24. The apparatus of claim 23, wherein the intermediate flow device comprises at least one of a pump, a valve, a choke, a sensor, and a flowmeter.

25. The apparatus of claim 14, wherein the at least one annular seal is rotatably supported by at least one bearing in the bore of the body.

26. The apparatus of claim 8, wherein the at least one annular seal supports a pressure differential thereacross in the annulus in which an uphole pressure is greater than a downhole pressure.

27. The apparatus of claim 8, wherein the at least one annular seal supports a pressure differential thereacross in the annulus in which a downhole pressure is greater than an uphole pressure.

28. The apparatus of claim 8, wherein the at least one annular seal comprises at least first and second annular seals stacked one above the other in the inner bore of the body.

29. The apparatus of claim 8, further comprising at least one external seal disposed on the exterior of the body and sealably engaging the internal passage of the riser.

30. The apparatus of claim 29, wherein the at least one external seal comprises at least one of a swab seal, a cup seal, and a chevron seal disposed on the exterior at the uphole end of the body.

31. The apparatus of claim 29, wherein the at least one external seal comprises a packer element being compressible on the exterior of the body.

* * * * *